US007654794B2

(12) United States Patent
Burdgick et al.

(10) Patent No.: US 7,654,794 B2
(45) Date of Patent: Feb. 2, 2010

(54) METHODS AND APPARATUS FOR ASSEMBLING STEAM TURBINES

(75) Inventors: Steven Sebastian Burdgick, Guilderland, NY (US); Boris Ivanovitch Frolov, Kharkov (UA)

(73) Assignee: General Electric Company, Schenectady, NY (US)

( * ) Notice: Subject to any disclaimer, the term of this patent is extended or adjusted under 35 U.S.C. 154(b) by 201 days.

(21) Appl. No.: 11/281,641

(22) Filed: Nov. 17, 2005

(65) Prior Publication Data

US 2007/0110575 A1 May 17, 2007

(51) Int. Cl.
*F01D 9/04* (2006.01)

(52) U.S. Cl. ..... 415/209.2; 415/209.4; 415/210.1; 29/525.14; 29/889.22

(58) Field of Classification Search ..... 415/189–190, 415/208.2, 209.2, 209.3, 209.4, 210.1; 416/193 R, 416/213 R, 213 A, 214 R, 214 A, 220 R, 416/220 A; 29/525.14, 889.2, 889.21, 889.22
See application file for complete search history.

(56) References Cited

U.S. PATENT DOCUMENTS

| | | | | | |
|---|---|---|---|---|---|
| 730,363 | A | * | 6/1903 | Geisenhoner | 29/889.21 |
| 792,659 | A | * | 6/1905 | Junggren | 415/209.2 |
| 1,819,485 | A | * | 8/1931 | Sedlmeir | 415/210.1 |
| 1,998,951 | A | * | 4/1935 | Downer | 415/209.4 |
| 2,278,040 | A | * | 3/1942 | Allen | 29/889.21 |
| 2,552,118 | A | * | 5/1951 | Sawyer | 415/208.2 |
| 4,509,238 | A | | 4/1985 | Lee et al. | |
| 4,764,658 | A | | 8/1988 | Panzeri | |
| 5,024,579 | A | | 6/1991 | Groenendaal, Jr. et al. | |
| 5,474,419 | A | | 12/1995 | Reluzco et al. | |
| 5,586,864 | A | | 12/1996 | Knorowski et al. | |
| 5,690,469 | A | * | 11/1997 | Deal et al. | 415/189 |
| 5,743,711 | A | | 4/1998 | Fournier et al. | |
| 5,788,456 | A | | 8/1998 | Maier | |
| 5,807,074 | A | | 9/1998 | Fournier et al. | |
| 5,984,633 | A | * | 11/1999 | Bachinger et al. | 415/209.2 |
| 6,325,596 | B1 | | 12/2001 | Tomko | |
| 6,981,836 | B2 | | 1/2006 | Tomko et al. | |

* cited by examiner

*Primary Examiner*—Christopher Verdier
(74) *Attorney, Agent, or Firm*—Armstrong Teasdale LLP

(57) ABSTRACT

Method and apparatus for assembling steam turbines are provided. The method of assembling a steam turbine includes providing an annular outer member, providing an annular inner member, coupling a plurality of airfoils to the inner member with a plurality of generally radial fastener assemblies such that the plurality of airfoils extend substantially radially outward from the inner member, and coupling each of the plurality of airfoils to the outer member.

17 Claims, 4 Drawing Sheets

METHODS AND APPARATUS FOR ASSEMBLING STEAM TURBINES

BACKGROUND OF THE INVENTION

This invention relates generally to steam turbines, and more particularly, to methods and apparatus for assembling steam turbines.

At least some known steam turbines include a turbine configuration that includes a plurality of stages of diaphragms. Within at least some known turbines, the last few stages of diaphragms are called fillet fabrications that are constructed of an annular outer ring, an annular inner ring, and a plurality of circumferentially-spaced airfoils, partitions, and/or nozzles, extending there-between. To facilitate enhancing the structural integrity of such diaphragms, the airfoils are welded to the inner and outer rings. More specifically, to facilitate achieving a pre-determined weld strength, known fillet fabrications include a large weld fillet at the interface defined between the airfoil and the ring.

During the fabrication of at least some known fillet fabrications, a flowpath surface of the inner ring and outer ring are first scribed with lines facilitate positioning the airfoils prior to the individual airfoils being welded in position. However, because known airfoils are typically heavy and are difficult to maneuver, the welding process may be a time-consuming and laborious task. In other known fabrication methods, a complex fixture is used to facilitate aligning and holding the airfoils during welding. However, known fixtures are expensive. Moreover, within each method of fabrication, weld distortion may occur due to local heating and shrinkage of the weld material during fabrication of the diaphragm. As a result, often extensive labor-adjustments and/or machining of the assembled diaphragm is necessary to ensure that predetermined tolerances and throat limitations defined between circumferentially-adjacent airfoils are satisfied. Additionally, distorted airfoils or rings generally can not fully obtain desired tolerances, such that stage performance may be compromised.

BRIEF DESCRIPTION OF THE INVENTION

In one aspect, a method for assembling a steam turbine is provided. The method comprises providing an annular outer member, providing an annular inner member, coupling a plurality of airfoils to the inner member with a plurality of fastener assemblies such that the plurality of airfoils extend substantially radially outward from the inner member, and coupling each of the plurality of airfoils to the outer member.

In another aspect, a diaphragm for a steam turbine is provided. The diaphragm includes a radially outer and radially inner member that are configured to extend substantially circumferentially within the steam turbine, and at least one airfoil that extends substantially radially between the outer and inner members. The at least one airfoil is coupled to one of the radially outer and radially inner members with a fastener assembly.

In a further aspect, a steam turbine is provided. The steam turbine includes at least one diaphragm including a radially outer and radially inner member that are configured to extend substantially circumferentially within the steam turbine, and a plurality of airfoils that extend between the outer and inner members. The plurality of airfoils are circumferentially spaced from each other and are coupled to one of the outer and inner members by a fastener assembly.

DETAILED DESCRIPTION OF THE INVENTION

Figure 1:
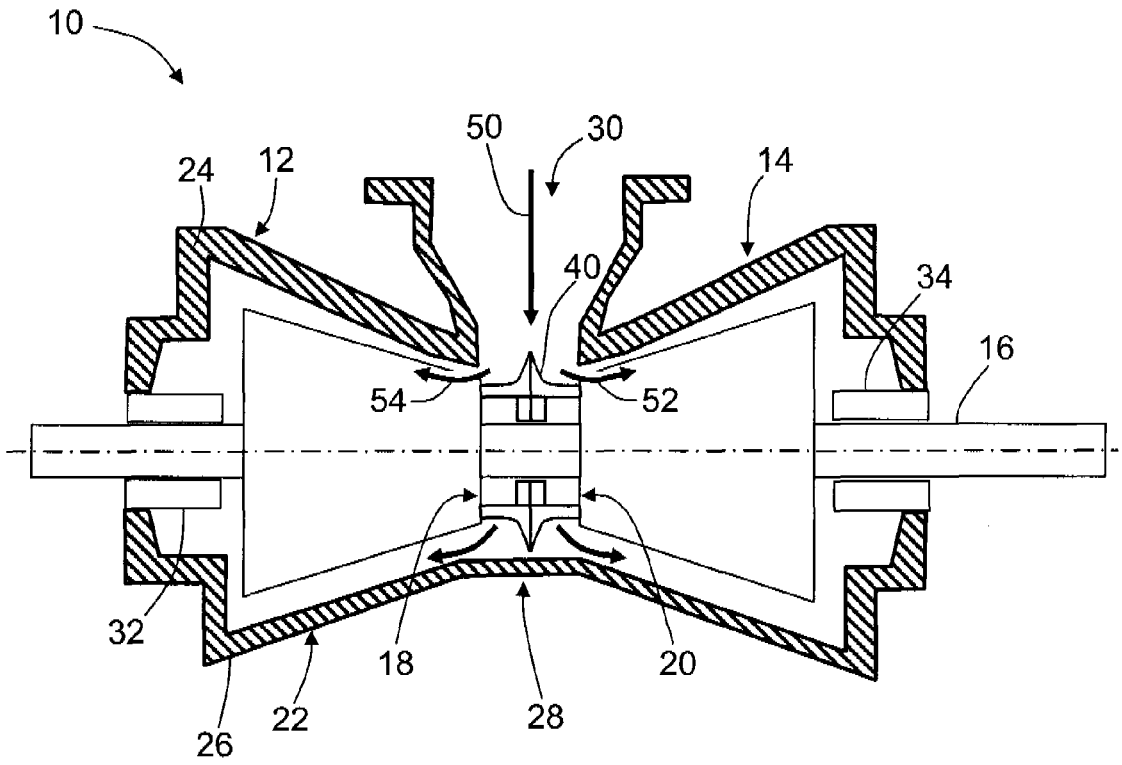
FIG. 1 (PRIOR ART)
FIG. 1 is a schematic illustration of an exemplary known opposed flow, or double flow, steam turbine.

FIG. 1 is a schematic illustration of an exemplary known opposed-flow steam turbine 10. Turbine 10 includes first and second low pressure (LP) sections 12 and 14. As is known in the art, each turbine section 12 and 14 includes a plurality of stages of diaphragms (not shown in FIG. 1). A rotor shaft 16 extends through sections 12 and 14. Each LP section 12 and 14 includes a nozzle 18 and 20. A single outer shell or casing 22 is divided along a horizontal plane and axially into upper and lower half sections 24 and 26, respectively, and spans both LP sections 12 and 14. A central section 28 of shell 22 includes a low pressure steam inlet 30. Within outer shell or casing 22, LP sections 12 and 14 are arranged in a single bearing span supported by journal bearings 32 and 34. A flow splitter 40 extends between first and second turbine sections 12 and 14.

It should be noted that although FIG. 1 illustrates a double flow low pressure turbine, as will be appreciated by one of ordinary skill in the art, the present invention is not limited to being used with low pressure turbines and can be used with any double flow turbine including, but not limited to intermediate pressure (IP) turbines or high pressure (HP) turbines. In addition, the present invention is not limited to being used with double flow turbines, but rather may be used with single flow steam turbines as well, for example.

During operation, low pressure steam inlet 30 receives low pressure/intermediate temperature steam 50 from a source, for example, an HP turbine or IP turbine through a cross-over pipe (not shown). The steam 50 is channeled through inlet 30 wherein flow splitter 40 splits the steam flow into two opposite flow paths 52 and 54. More specifically, the steam 50 is routed through LP sections 12 and 14 wherein work is extracted from the steam to rotate rotor shaft 16. The steam exits LP sections 12 and 14 and is routed, for example, to an intermediate pressure turbine (not shown).

Figure 2:
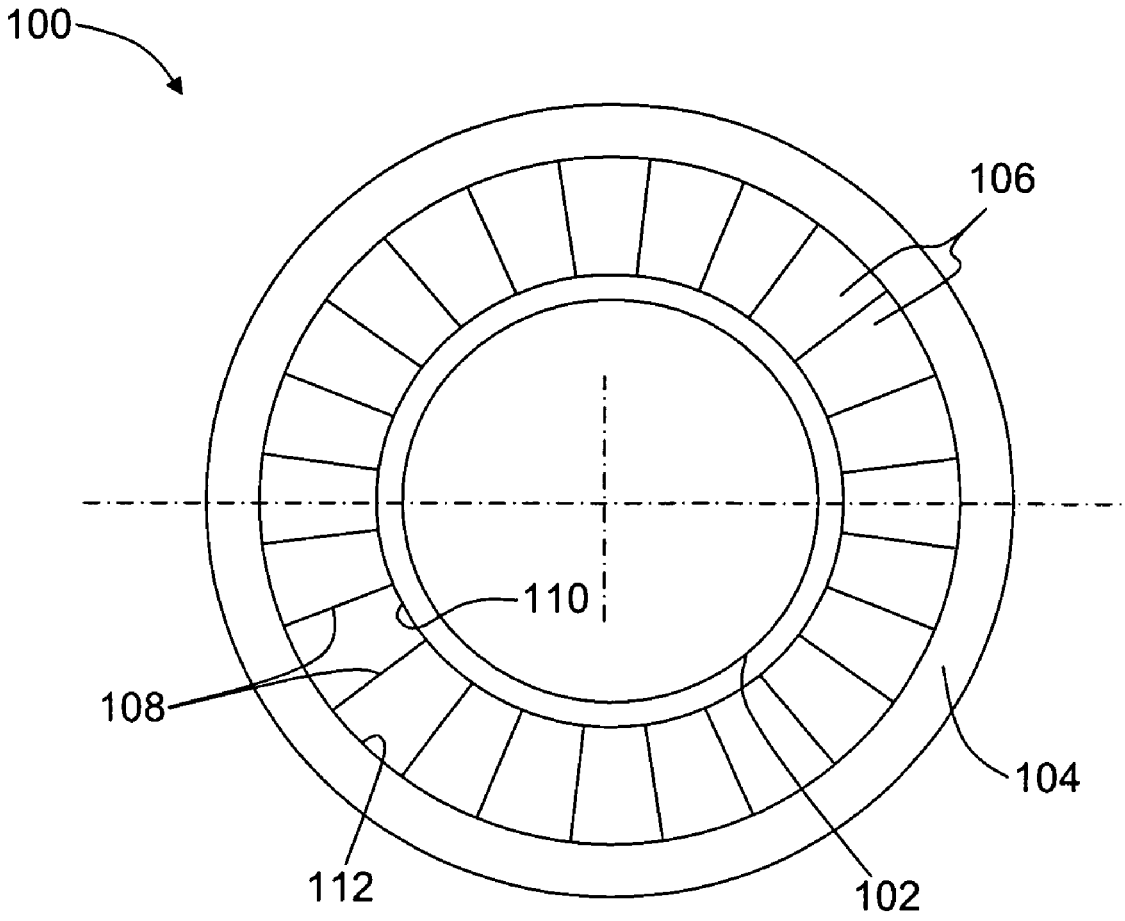
FIG. 2 is an enlarged schematic view of an exemplary diaphragm that may be used with the steam turbine shown in FIG. 1.

FIG. 2 is an enlarged schematic view of an exemplary diaphragm 100 that may be used with steam turbine 10 (shown in FIG. 1). In one embodiment, diaphragm 100 is a last stage diaphragm 100 of turbine 10. Diaphragm 100 includes an annular inner web or ring 102, an annular outer ring 104, and a plurality of nozzles or airfoils 106 extending therebetween. Outer ring 104 is radially outward of, and substantially concentrically aligned with, inner ring 102. Nozzles 106 are spaced circumferentially between rings 102 and 104 and each extends substantially radially between inner and outer rings 102 and 104, respectively.

A radially outer surface 110 of inner ring 102 and a radially inner surface 112 of outer ring 104 define radially inner and radially outer boundaries of a flowpath defined through diaphragm 100.

Figure 3:
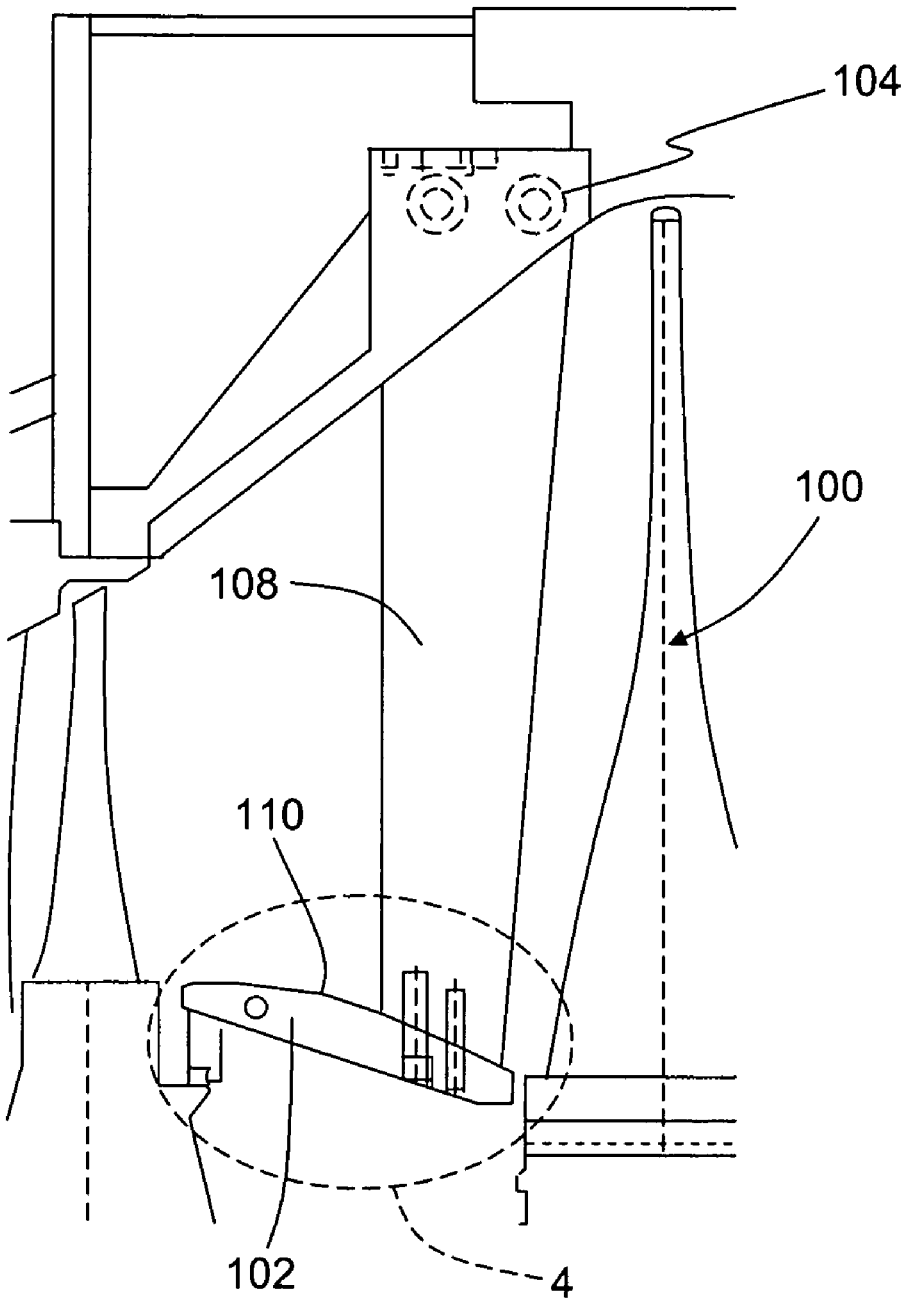
FIG. 3 is an enlarged schematic view of a portion of the diaphragm shown in FIG. 2.
Figure 4:
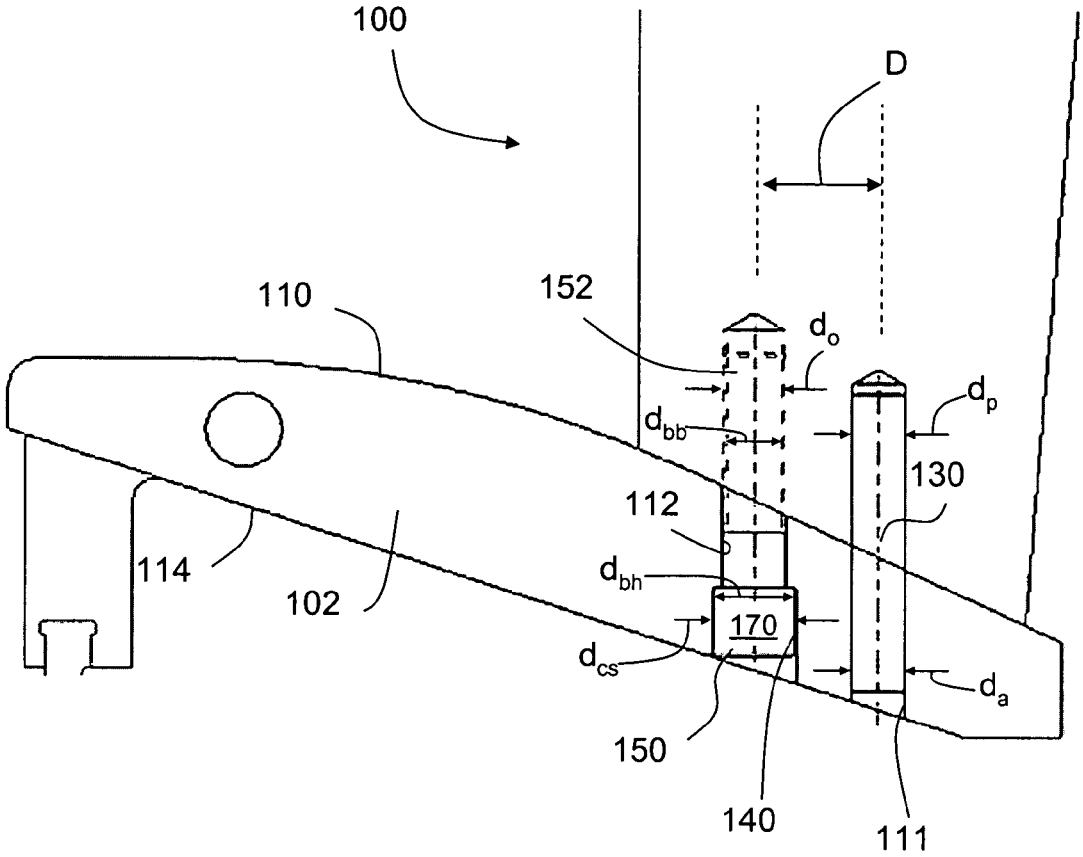
FIG. 4 is an enlarged view of a portion of the diaphragm shown in FIG. 3 and taken along area 4.

FIG. 3 is an enlarged schematic view of a portion of diaphragm 100. FIG. 4 is an enlarged view of a portion of diaphragm 100 taken along area 4. In the exemplary embodiment, diaphragm inner ring 102 is fabricated from a rolled or forged ring of material. Alternatively, diaphragm inner ring 102 may be fabricated in any means that enables ring 102 to function as described herein. Ring 102 includes a plurality of alignment openings 111 and a plurality of coupling openings 112. In the exemplary embodiment, openings 111 are pin openings and openings 112 are bolt openings. Openings 111 and 112 each extend generally radially through inner ring 102 between flowpath surface 110 and a radially inner surface 114 of inner ring 102.

Openings 111 and 112 are each spaced circumferentially about inner ring 102. More specifically, in the exemplary embodiment, openings 111 are spaced a distance D downstream from openings 112. Alternatively, openings 111 may be formed at any location with respect to openings 112 that facilitates assembly of diaphragm 100 as described herein. Moreover, in the exemplary embodiment, openings 111 have a diameter $d_a$ that is smaller than a diameter $d_o$ of each opening 112. Alternatively, opening diameter $d_a$ may be approximately the same size, or larger than coupling opening diameter $d_o$. More specifically, in the exemplary embodiment, each opening diameter $d_a$ is approximately the same size as a diameter $d_p$ of each alignment pin 130 inserted therein.

In the exemplary embodiment, alignment openings 111 are drilled using a precision machining process. Alternatively, openings 111 may be formed using any process that enables openings 111 to function as described herein. Specifically, the location of openings 111 facilitates determining circumferential spacing between circumferentially adjacent airfoils 106 along the inner flowpath. Moreover, the location of openings 111 also facilitates aligning each airfoil 106 axially relative to inner ring 102 and more specifically, relative to flowpath surface 110. For example, in an alternative embodiment, openings 111 are forward of openings 112.

Openings 112 are spaced circumferentially about inner ring 102 and each includes a recessed or countersunk portion 140 that extends inward from radially inner surface 114 towards flowpath surface 110. Between countersunk portion 140 and flowpath surface 110, openings 112 have a diameter $d_o$ that is smaller than a diameter $d_{cs}$ of countersunk portion 140. In the exemplary embodiment, countersunk portion diameter $d_{cs}$ is larger than a diameter $d_{bh}$ of each coupling bolt 150 received therein, and opening diameter $d_o$ is larger than a corresponding diameter $d_{bb}$ of each coupling bolt shank 152.

In the exemplary embodiment, coupling openings 112 are drilled using a precision machining process. Alternatively, openings 112 may be formed using any process that enables openings 112 to function as described herein. Specifically, the location of openings 112 facilitates determining a throat area defined between circumferentially adjacent airfoils 106. In the exemplary embodiment, openings 112 are slightly oversized to facilitate accommodating slight alignment modifications while setting individual throat areas.

During fabrication of diaphragm 100, initially openings 111 and 112 are formed generally radially within inner ring 102. A first airfoil 106 is then positioned relative to inner ring flowpath surface 110, and an alignment pin 130 is slidably received within a respective alignment opening 111. More specifically, alignment pin 130 is inserted generally radially from inner surface 114, through inner ring 102, and into the airfoil 106 positioned against flowpath surface 110. Each pin 130 is received in a friction fit within a respective opening 111. Pins 130 facilitate positioning airfoils 106 both circumferentially with respect to each other, as well as axially with respect to inner ring flow path surface 110. Alternatively, a plurality of pins 130 may be used to facilitate aligning each airfoil 106 with respect to every other airfoil.

Airfoils 106 are then oriented with respect to diaphragm 100 and coupling openings 112 are then formed within inner ring 102 and within airfoils 106. In the exemplary embodiment, the portion of openings 112 defined within airfoils 106 is threaded. Each coupling bolt 150 is then inserted within each opening 112 to facilitate securing each airfoil 106 to inner ring 102. More specifically, even as bolts 150 are threadably coupled within each airfoil 106, an orientation of airfoils 106 may still be rotated slightly to adjust individual nozzle throat areas. In an alternative embodiment, a plurality of bolts 150 are used to facilitate securing each airfoil 106 to inner ring 102.

After each respective throat area has been defined, each airfoil 106 is tack-welded to outer ring 104 to facilitate maintaining an orientation of each airfoil 106 as other airfoils 106 are coupled within diaphragm 100. After each throat area has been set, coupling bolts 150 are securely fastened within openings 112 such that a head portion 170 of each bolt 150 is received within each respective opening countersunk portion 140. As such, bolts 150 do not create any additional rings, ledges, or protrusions that could adversely affect fluid flow through diaphragm 100. In an alternative embodiment, openings 112 receive only a portion of bolts 150.

After airfoils 106 are spaced circumferentially around inner ring 102 and outer ring 104 has been tack-welded to each airfoil 106 included within diaphragm 100, airfoils 106 are then securely welded to outer ring 104. In one embodiment, a plurality of additional alignment openings (not shown) is formed to facilitate securing each airfoil 106 in its final orientation. More specifically, airfoils 106 are not welded sequentially in order circumferentially about diaphragm 100, but rather are welded in patterns that facilitate even welding and reducing welding distortion and deformation.

Accordingly, a diaphragm is formed in a manner that is more cost-effective and less time-consuming than known diaphragms. Specifically, because diaphragm 100 includes a bolted inner ring 102, during fabrication, less welding is performed on diaphragm 100, such that the cycle time required for fabrication of diaphragm 100 is reduced in comparison to known diaphragms. Moreover, because inner ring coupling openings 112 are slightly oversized, openings 112 facilitate more accurate throat area definitions to be formed in a more cost-effective manner than is possible with known diaphragms. As a result, turbine performance and efficiency is facilitated to be enhanced. In addition, because diaphragm 100 requires much less welding than known diaphragms, weld distortion is reduced within diaphragm 100, such that turbine performance is facilitated to be improved.

Exemplary embodiments of diaphragms and steam turbines are described above in detail. Although the diaphragms are herein described and illustrated in association with the above-described steam turbine, it should be understood that the present invention may be used with any steam turbine configuration. More specifically, the diaphragms are not limited to the specific embodiments described herein, but rather, aspects of each diaphragms may be utilized independently and separately from other turbines or diaphragms described herein.

While the invention has been described in terms of various specific embodiments, those skilled in the art will recognize that the invention can be practiced with modification within the spirit and scope of the claims.

What is claimed is:

1. A method for assembling a steam turbine, said method comprising:

providing an annular outer member;

providing an annular inner member;

rotatably coupling a plurality of airfoils to the inner member with a first plurality of fasteners that are each inserted into one of a plurality of circumferentially-spaced bores extending substantially radially through the inner member and oriented towards the outer member such that the plurality of airfoils extend substantially radially outward from the inner member adjusting the plurality of airfoils into a final airfoil position;

limiting rotational movement of the plurality of airfoils;

coupling each of the plurality of airfoils to the inner member with a second plurality of fasteners; and welding each of the plurality of airfoils to the outer member.

2. A method in accordance with claim 1 wherein coupling a plurality of airfoils to the inner member with a first plurality of fasteners further comprises inserting at least one alignment pin generally radially into each of the plurality of airfoils to facilitate aligning each of the plurality of airfoils with respect to the inner member.

3. A method in accordance with claim 1 wherein coupling a plurality of airfoils to the inner member with a second plurality of fasteners further comprises coupling each of the plurality of airfoils to the inner member with at least one bolt.

4. A method in accordance with claim 1 further comprising forming the plurality of circumferentially-spaced bores within the inner member such that each of the bores is sized to receive a portion of the first plurality of fasteners therethrough to facilitate securing each of the plurality of airfoils to the inner member

5. A diaphragm for a steam turbine, said diaphragm comprises:

a radially outer member configured to extend substantially circumferentially within said steam turbine;

a radially inner member configured to extend substantially circumferentially within said steam turbine, said inner member comprising a plurality of circumferentially-spaced bores extending substantially radially through said inner member towards said outer member, some of said plurality of bores each comprise a countersunk portion; and at least one airfoil extending substantially radially between said outer and inner members, said at least one airfoil rotatably coupled to said radially inner member with a first plurality of fasteners, said first plurality of fasteners facilitate orienting said at least one airfoil relative to said inner member, said at least one airfoil coupled to said radially inner member with a second plurality of fasteners, said at least one airfoil welded to said radially outer member.

6. A diaphragm in accordance with claim 5 wherein said first plurality of fasteners comprises at least one alignment pin and said second plurality of fasteners comprises at least one bolt.

7. A diaphragm in accordance with claim 5 wherein one of said radially inner member and said radially outer member comprises a plurality of openings extending therethrough, said plurality of openings facilitate aligning said at least one airfoil with respect to said diaphragm.

8. A diaphragm in accordance with claim 5 wherein said first and second plurality of fasteners facilitate reducing weld distortion within said diaphragm.

9. A diaphragm in accordance with claim 5 wherein said first and second plurality of fasteners facilitate reducing assembly time of said diaphragm.

10. A diaphragm in accordance with claim 5 wherein said first and second plurality of fasteners facilitate improving turbine performance.

11. A steam turbine comprising at least one diaphragm comprising a radially outer member, a radially inner member comprising a plurality of circumferentially-spaced bores extending substantially radially therethrough and towards said outer member, and a plurality of airfoils extending therebetween and spaced circumferentially from each other, said radially outer and inner members configured to extend circumferentially within said turbine, said plurality of airfoils rotatably coupled to said radially inner member with a first plurality of fasteners that orient at least one airfoil relative to said inner member, said plurality of airfoils coupled to said radially inner member with a second plurality of fasteners, said plurality of airfoils welded to said radially outer member.

12. A steam turbine in accordance with claim 11 wherein said radially inner member and said radially outer member comprise a plurality of circumferentially-spaced openings extending therethrough, said openings facilitate aligning each of said plurality of airfoils with respect to said diaphragm.

13. A steam turbine in accordance with claim 11 wherein said plurality of circumferentially spaced bores are sized to receive at least a portion of said second plurality of fasteners therethrough for securing each of said plurality of airfoils within said diaphragm.

14. A steam turbine in accordance with claim 11 wherein said first plurality of fasteners comprise an alignment pin, said second plurality of fasteners comprises a bolt, said alignment pin facilitates aligning each of said plurality of airfoils within said diaphragm, said bolt facilitates securing each of said plurality of airfoils within said diaphragm.

15. A steam turbine in accordance with claim 11 wherein said first and second plurality of fasteners facilitate improving an operating efficiency of said steam turbine.

16. A steam turbine in accordance with claim 11 wherein said first and second plurality of fasteners facilitate reducing weld distortion of said diaphragm.

17. A steam turbine in accordance with claim 11 wherein said first and second plurality of fasteners facilitate reducing assembly time of said diaphragm.

* * * * *

UNITED STATES PATENT AND TRADEMARK OFFICE

CERTIFICATE OF CORRECTION

PATENT NO. : 7,654,794 B2
APPLICATION NO. : 11/281641
DATED : February 2, 2010
INVENTOR(S) : Burdgick et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 207 days.

Signed and Sealed this

Twenty-third Day of November, 2010

David J. Kappos

David J. Kappos
*Director of the United States Patent and Trademark Office*